US011452672B2

(12) United States Patent
Gift et al.

(10) Patent No.: US 11,452,672 B2
(45) Date of Patent: Sep. 27, 2022

(54) PEDIATRIC DOSING DISPENSER

(71) Applicant: Berry Global, Inc., Evansville, IN (US)

(72) Inventors: Steven Gift, Lititz, PA (US); Michael M. Makhlouf, Lititz, PA (US); Jacob B. Robison, Marietta, PA (US); Brian Martin, New Providence, PA (US); John A. Vassallo, Lititz, PA (US)

(73) Assignee: Berry Global, Inc., Evansville, IN (US)

( * ) Notice: Subject to any disclaimer, the term of this patent is extended or adjusted under 35 U.S.C. 154(b) by 292 days.

(21) Appl. No.: 16/806,462

(22) Filed: Mar. 2, 2020

(65) Prior Publication Data

US 2020/0276083 A1 Sep. 3, 2020

Related U.S. Application Data

(60) Provisional application No. 62/812,471, filed on Mar. 1, 2019, provisional application No. 62/818,900, filed on Mar. 15, 2019.

(51) Int. Cl.

| | |
|---|---|
| ***A61J 1/14*** | (2006.01) |
| ***B65D 47/20*** | (2006.01) |
| ***A61J 1/20*** | (2006.01) |
| ***A61J 1/22*** | (2006.01) |
| ***B65B 3/00*** | (2006.01) |

(52) U.S. Cl.

CPC ..... *A61J 1/1418* (2015.05); *A61J 1/2048* (2015.05); *A61J 1/2096* (2013.01); *A61J 1/22* (2013.01); *B65B 3/003* (2013.01); *B65D 47/2037* (2013.01)

(58) Field of Classification Search

CPC ..... A61J 1/1418; A61J 1/2048; A61J 1/2096; A61J 1/22; B65D 47/2037; B65B 3/003

USPC ..... 220/200, 202, 203.03, 202.04, 202.05, 220/202.06, 203.19, 203.29

See application file for complete search history.

(56) References Cited

U.S. PATENT DOCUMENTS

| | | | | |
|---|---|---|---|---|
| 3,853,157 | A | 12/1974 | Madaio | |
| 4,493,348 | A | 1/1985 | Lemmons | |
| 4,940,167 | A | 7/1990 | Fillmore | |
| 5,314,084 | A | 5/1994 | Folta | |
| 5,573,516 | A | 11/1996 | Tyner | |
| 5,620,434 | A | 4/1997 | Brony | |
| 5,911,252 | A | 6/1999 | Cassel | |
| 6,065,648 | A * | 5/2000 | Tauber | B65D 47/242 222/521 |

(Continued)

FOREIGN PATENT DOCUMENTS

| | | | |
|---|---|---|---|
| EP | 1424292 A1 * | 6/2004 | B65D 47/2037 |
| GB | 2513840 | 11/2014 | |

(Continued)

OTHER PUBLICATIONS

International (PCT) Search Report and Written Opinion for PCT/US2020020654 dated May 6, 2020, 10 pages.

(Continued)

*Primary Examiner* — Rafael A Ortiz

(74) *Attorney, Agent, or Firm* — Barnes & Thornburg LLP

(57) ABSTRACT

A package that is configured to store and dispense fluids. The package includes a container and a dosing dispenser for closing an opening to the container. The dosing dispenser includes a body portion having a syringe receiver that is configured to receive a syringe to remove fluid from the container.

19 Claims, 6 Drawing Sheets

(56) References Cited

U.S. PATENT DOCUMENTS

| | | | | |
|---|---|---|---|---|
| 6,405,885 | B1 | 6/2002 | Elliott | |
| 7,077,176 | B2 | 7/2006 | Py | |
| 7,404,495 | B2 | 7/2008 | Keung | |
| 8,459,312 | B2 | 6/2013 | Manera | |
| 10,058,481 | B1 | 8/2018 | Russo | |
| 11,242,185 | B2 * | 2/2022 | Marantis | A61M 1/60 |
| 2006/0186077 | A1 | 8/2006 | Robinson | |
| 2007/0214692 | A1 | 9/2007 | Ferrara | |
| 2008/0237278 | A1 | 10/2008 | Gaus | |
| 2010/0327010 | A1 * | 12/2010 | Manera | B65D 47/2031 141/357 |
| 2011/0168292 | A1 * | 7/2011 | Luzbetak | B65D 47/0804 141/2 |
| 2012/0103468 | A1 | 5/2012 | Terwilliger | |
| 2012/0103469 | A1 | 5/2012 | Terwilliger | |
| 2012/0103470 | A1 | 5/2012 | Terwilliger | |
| 2012/0104054 | A1 | 5/2012 | Terwilliger | |
| 2012/0211505 | A1 | 8/2012 | Vollers | |
| 2013/0102989 | A1 | 4/2013 | McCoy | |
| 2013/0160891 | A1 | 6/2013 | Vassallo | |
| 2013/0180618 | A1 | 7/2013 | Py | |
| 2014/0261860 | A1 | 9/2014 | Heath | |
| 2015/0112296 | A1 * | 4/2015 | Ishiwata | A61J 1/1406 604/406 |
| 2015/0209230 | A1 | 7/2015 | Lev | |
| 2016/0130049 | A1 | 5/2016 | Rogers | |
| 2018/0098913 | A1 | 4/2018 | Vassallo | |
| 2018/0207061 | A1 | 7/2018 | Fox | |

FOREIGN PATENT DOCUMENTS

| | | | | |
|---|---|---|---|---|
| GB | 2513840 | A | 11/2014 | |
| WO | 2007027567 | | 3/2007 | |
| WO | WO-2008065879 | A1 * | 6/2008 | A61J 1/1412 |
| WO | WO-2009133754 | A1 * | 11/2009 | A61J 1/2089 |
| WO | 2018122019 | | 7/2018 | |
| WO | WO-2019090079 | A1 * | 5/2019 | A61L 2/08 |

OTHER PUBLICATIONS

International (PCT) Search Report and Written Opinion for PCT/US2020/020659 dated May 7, 2020, 10 pages.

International (PCT) Search Report and Written Opinion for PCT/US2020/020650 dated May 7, 2020, 16 pages.

Office Action dated Dec. 13, 2021 for U.S. Appl. No. 16/806,284, BP-540 US-U || (pp. 1-10).

* cited by examiner

PEDIATRIC DOSING DISPENSER

PRIORITY CLAIM

This application claims priority under 35 U.S.C. § 119(e) to U.S. Provisional Application No. 62/812,471, filed Mar. 1, 2019, and U.S. Provisional Application No. 62/818,900, filed Mar. 15, 2019, both of which are expressly incorporated by reference herein.

BACKGROUND

The present disclosure relates to a package configured to store and dispense fluids, and in particular, to a package including a container and a closure. More particularly, the present disclosure relates to a package including a container and a closure coupled to the container to close selectively an opening formed in the container.

SUMMARY

A package in accordance with the present disclosure includes a container and a dosing dispenser coupled to the container to control release of fluid from the bottle. In illustrative embodiments, the dosing dispenser includes a closure coupled removably to the container. The closure includes an inner cap mounted to a filler neck of the container in a fixed position relative to the filler neck and an outer cap coupled to the inner cap.

In illustrative embodiments, the inner cap includes an inner top wall formed to include a first opening, an inner side wall arranged to extend downwardly from the inner top wall and circumferentially around a central axis, and an inner plug unit coupled to an outer surface of the inner top wall and arranged to extend upwardly away from the inner top wall. The outer cap includes an outer top wall formed to include a second opening, an outer side wall arranged to extend downwardly from the outer top wall and that extends circumferentially about the central axis, and an outer plug unit coupled to a bottom surface of the outer top wall and arranged to extend downwardly away from the top wall into engagement with the inner plug unit.

In illustrative embodiments, the outer cap is mounted to the inner cap for rotation relative to the inner cap about a central axis between a closed position and an opened position to open and close a fluid flow passageway that extends between the first and second openings in the inner cap and the outer cap. In the closed position, the outer top wall and the inner top wall are spaced apart from one another by a first distance and the inner plug unit and the outer plug unit cooperate to block fluid flow through the first and second openings. In the opened position, the outer top wall is spaced apart from the inner top wall by a second distance greater than the first distance and first and second openings are opened to allow fluid to flow through the fluid passageway.

In illustrative embodiments, the outer cap is adapted to receive a syringe to remove a fluid from the chamber when the outer cap is in the opened position. The closure further comprises anti-suction means for blocking formation of a seal between a child's mouth and an upper surface of the outer top wall. If the child attempts to apply a suction force on the outer top wall over the second opening, air is drawn into the child's mouth without any fluid being removed through the second opening.

BRIEF DESCRIPTIONS OF THE DRAWINGS

The detailed description particularly refers to the accompanying figures in which.

DETAILED DESCRIPTION

Figure 1:
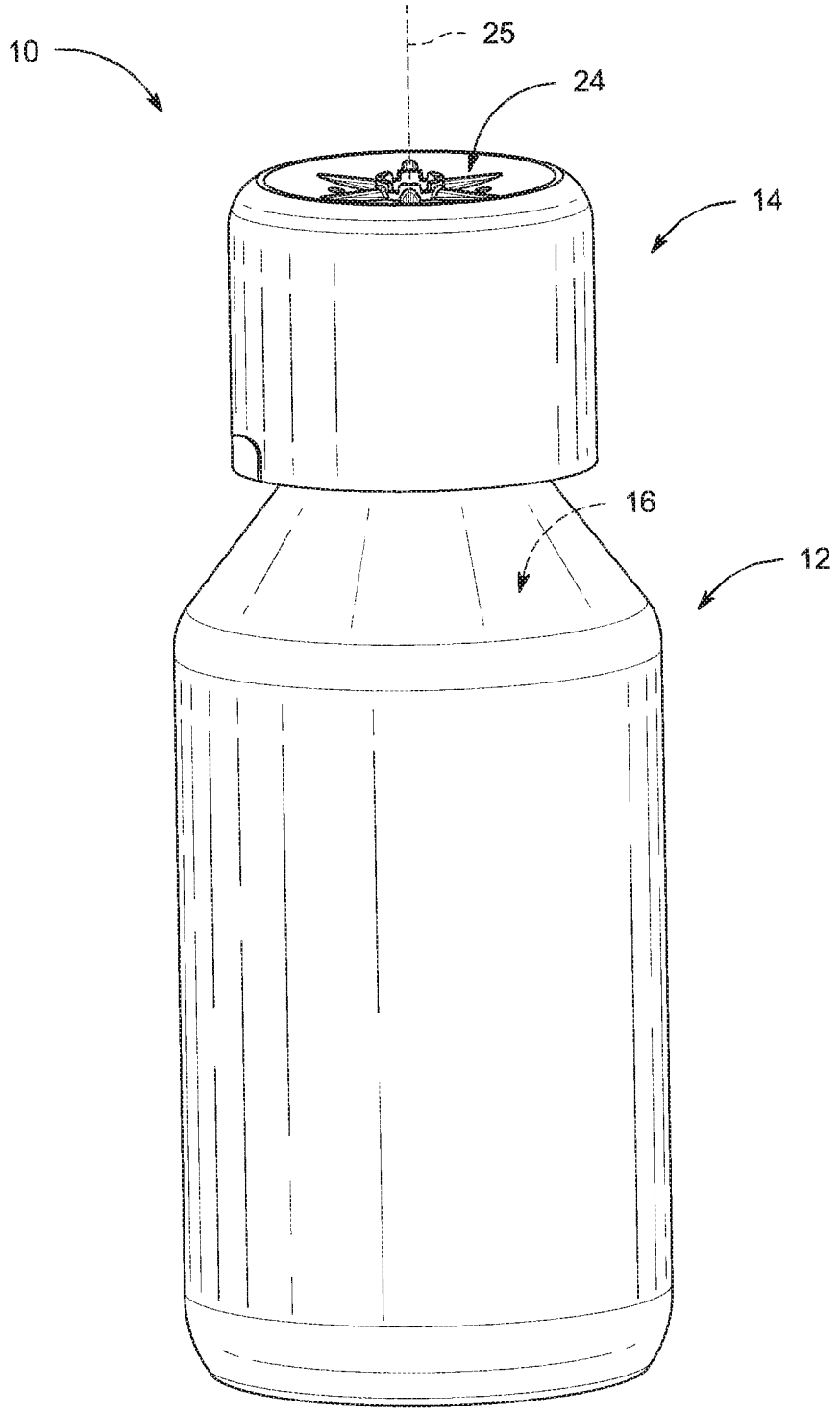
FIG. 1 is a perspective view of a package in accordance with the present disclosure showing that the package includes a container and a closure coupled to the container and suggesting that a portion of the closure may be rotated about a vertical axis to change the closure from closed arrangement to an opened arrangement.
Figure 2:
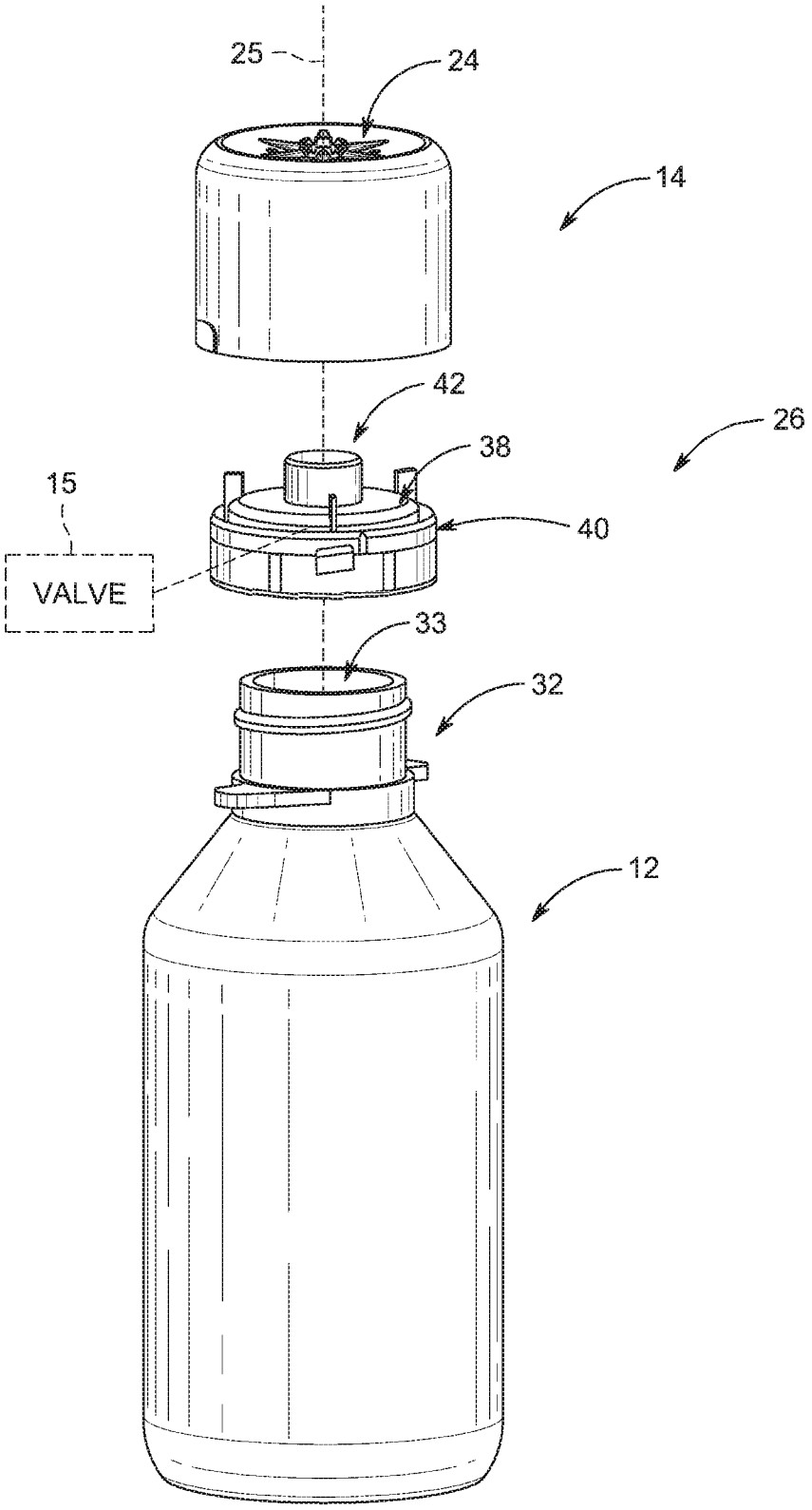
FIG. 2 is an exploded assembly view of the package of FIG. 1 showing that the package includes, from top to bottom, the closure including an outer cap and an inner cap, and the container below the closure.
Figure 5A:
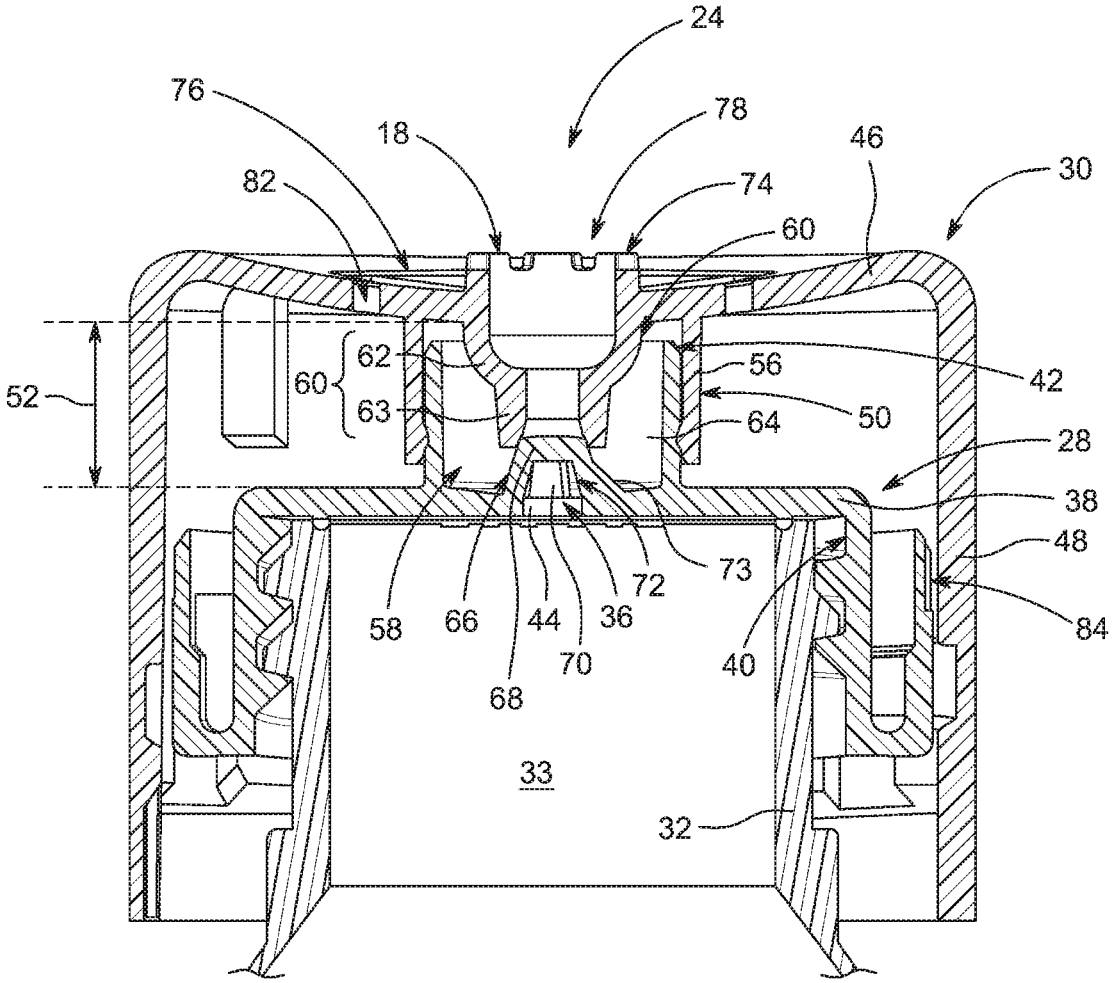
FIG. 5A is a cross sectional view taken along line 5-5 in FIG. 4 of the closure in the closed arrangement showing that the outer cap includes an outer plug and the inner cap includes an inner plug engaged with the outer plug to block flow through a fluid passage.
Figure 5B:
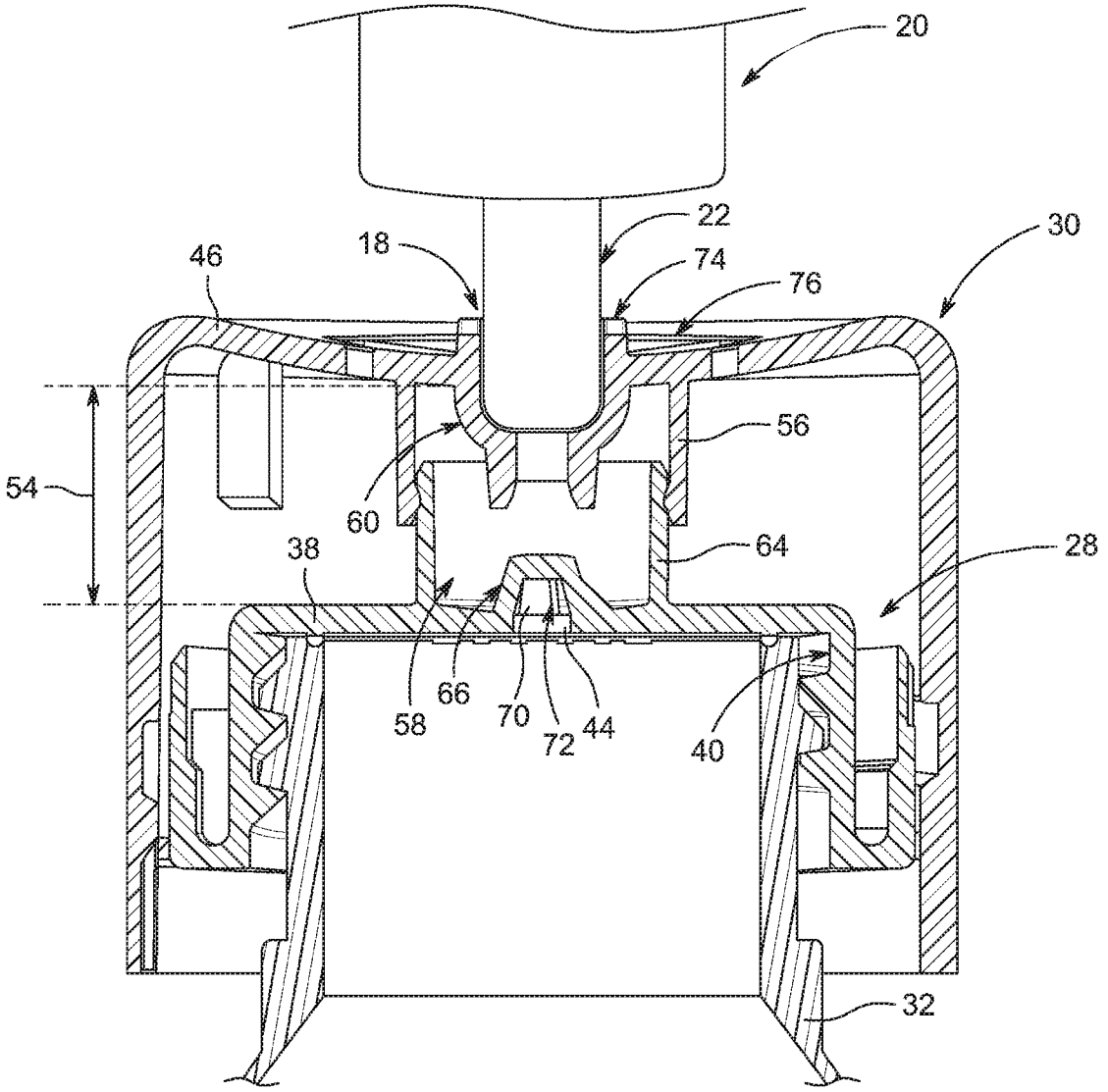
FIG. 5B is a cross sectional view similar to FIG. 5A showing outer plug unit moved relative to the inner plug unit to establish the opened arrangement of the closure and an injection tip of a syringe inserted into the syringe receiver to draw fluid from the container.
Figure 6:
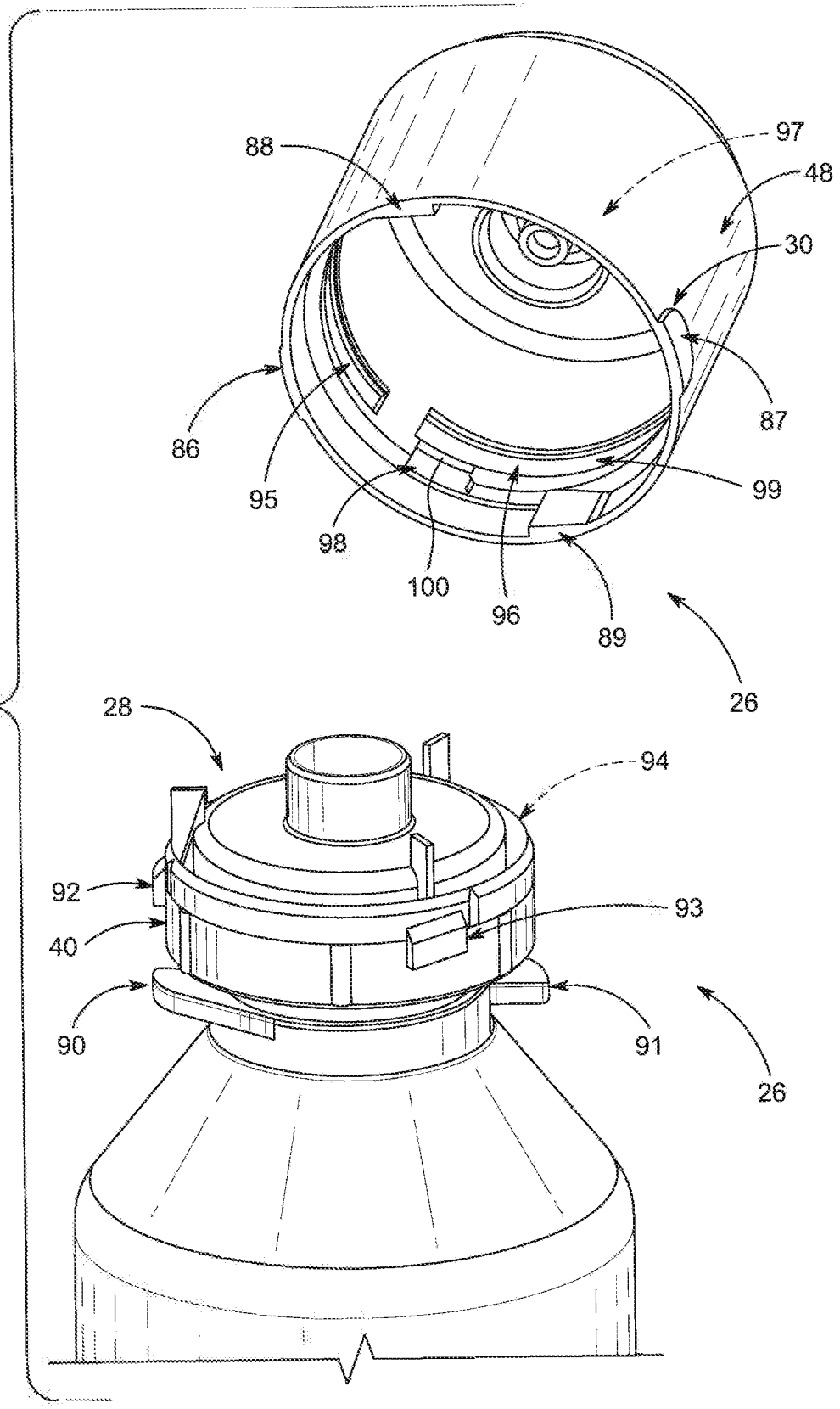
FIG. 6 is a perspective and partially exploded view of the package showing a closure-release mechanism included in the closure.

A package 10 in accordance with the present disclosure is shown in FIGS. 1 and 2. The package 10 includes a container 12 and closure 14. The closure 14 is coupled to the container 12 to block movement of fluid stored in a product-storage region 16 of the container 12. The closure 14 may be changed from a closed arrangement, as shown in FIG. 5A, in which fluid flow out of the product-storage region 16 is blocked, to an opened arrangement, as shown in FIG. 5B, in which fluid flow from the product-storage region 16 through the closure 14 is permitted using a syringe 20 having an injection tip 22. The closure 14 includes an anti-suction feature 24 to control removal of fluid from through from the container 12, as shown in FIGS. 3 and 4, and a closure-release mechanism 26 to block the closure 14 from changing from the closed arrangement to the opened arrangement as shown in FIG. 6.

Figure 3:
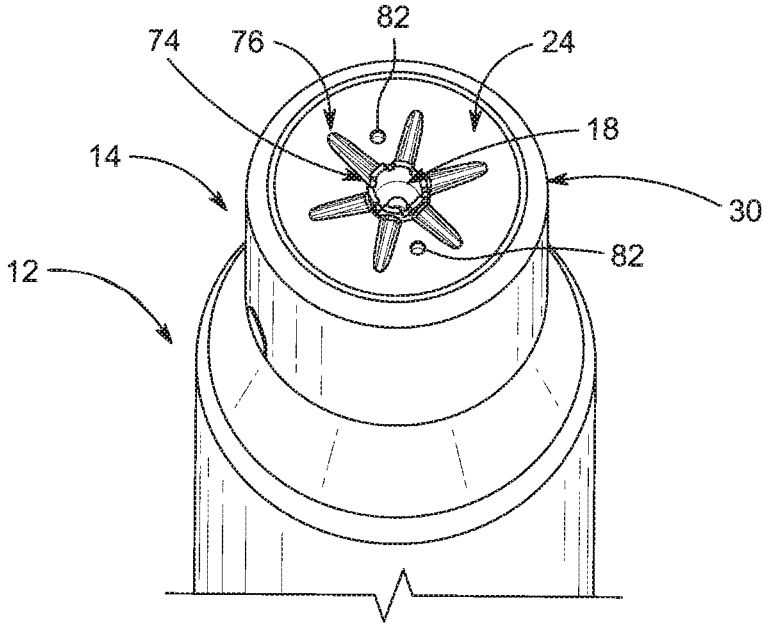
FIG. 3 is a partial perspective view of the closure of FIGS. 1 and 2 showing that the outer cap is formed to include a dispense aperture and the closure further includes an anti-suction feature coupled to an upper surface of the outer cap and arranged around the aperture.
Figure 4:
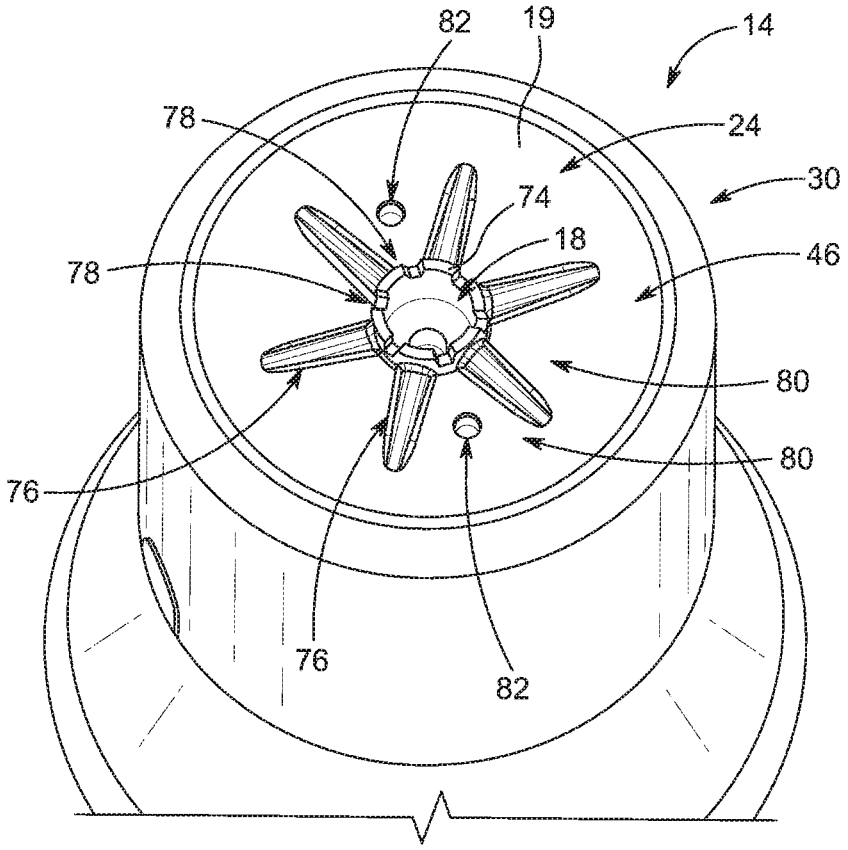
FIG. 4 is an enlarged perspective view of the outer cap and the anti-suction feature coupled to the outer cap shown in FIG. 3.

The anti-suction feature 24 is configured to provide anti-suction means in accordance with the present disclosure for minimizing formation of a complete seal along a surface 19 surrounding a dispense aperture 18 formed in closure 14 so that sufficient suction is blocked from forming over the dispense aperture 18 as shown in FIGS. 3 and 4. The anti-suction means provide a series of raised and lowered areas along the surface 19 surrounding the dispense aperture 18. If a user, such as a child, places their mouth onto the closure 14 over the dispense aperture 18, the anti-suction means maintains spaces between the closure 14 and the user's mouth. If the user attempts to provide a suction force with their mouth over the dispense aperture 18, the spaces maintained between closure 14 by the anti-suction means allow air to be drawn into the user's mouth without releasing fluid from the container through the dispense aperture 18.

The closure includes an inner cap 28 and an outer cap 30 as shown in FIGS. 1 and 2. The inner cap 28 is mounted on a filler neck 32 of the container 12 to restrict flow through a mouth 33 of the filler neck as suggested in FIG. 2. The inner cap 28 is engaged with a thread 34 to retain the inner cap 28 to the filler neck 32 in a fixed position. In some embodiments, the inner cap 28 may be formed integral with the container 12. The outer cap 30 is formed to include dispense aperture 18 and is coupled to the inner cap 28 for rotation relative to the inner cap 28 about a central closure axis 25. The outer cap 30 may be rotated relative to the inner cap 28 from a closed position, as shown in FIG. 5A, to an opened position, as shown in FIG. 5B. In the closed position, portions of the inner cap 28 and the outer cap 30 engage one another to close a fluid passageway 36 and block fluid from passing though the closure 14. In the opened position, the outer cap 30 is translated outward relative to the inner cap 28 along axis 25 to open the fluid passageway 36 so that syringe 20 can draw fluid therethrough and out of dispense aperture 18.

The inner cap 28 includes an inner top wall 38, an inner side wall 40 arranged to extend downwardly from the inner top wall 38 and circumferentially around central axis 25, and an inner plug unit 42 as shown in FIGS. 2 and 5A-5B. Inner top wall extends over the mouth 33 of the filler neck 32 to restrict fluid flow therethrough and is formed to include an opening 44 that opens into mouth and partially defines fluid passageway 36. The inner side wall 40 threadingly engages with the filler neck 32 to retain the closure 14 to the container 12. The inner plug unit 44 is coupled to an outer surface of the inner top wall 38 and is arranged to extend upwardly away from the inner top wall 38. The inner cap 28 of the closure 14 may further include a one-way valve 15, as shown in FIG. 2, that blocks release of fluid from the product storage region 16 until sufficient suction is established over dispense aperture 18 formed in the closure 14. The injection tip 22 of the syringe 20 is sized to fit into dispense aperture 18 so that syringe 20 can provide the sufficient suction needed to remove fluid through the valve 15. In some embodiments, only syringe 20 is able to provide a sufficient suction force to remove fluid through dispensing aperture 18 due to the anti-suction feature 24 included in closure 14.

The outer cap 30 includes an outer top wall 46, an outer side wall 48 arranged to extend downwardly from the outer top wall 46 and circumferentially about the central axis 25, and an outer plug unit 50 as shown in FIGS. 5A and 5B. The outer top wall 46 has a concave shape such that it extends toward the inner top wall 38 of the inner cap 28 as it extends from an outer perimeter 47 toward the central axis 25. The outer side wall 48 is coupled to the inner side wall 40 of the inner cap 28 to retain the outer cap 30 to the container 12. The outer plug unit 50 is coupled to a bottom surface of the outer top wall and is arranged to extend downwardly away from the top wall.

The inner plug unit 42 and the outer plug unit 50 cooperate to open and close the fluid passageway 36 as the outer cap 30 moves relative to the inner cap 28 to change between the opened position and the closed position as shown in FIGS. 5A and 5B. In the closed position, the outer top wall 46 and the inner top wall 38 are spaced apart from one another by a first distance 52 and the inner plug unit 42 and the outer plug unit 50 cooperate to block fluid flow through the fluid passageway 36. In the opened position, the outer top wall 46 is spaced apart from the inner top wall 38 by a second distance 54 greater than the first distance 52 and fluid passageway 36 is opened to allow fluid to flow therethrough.

The outer plug unit 50 includes an outer seal ring 56 that extends circumferentially around the central axis to define a chamber 58 radially inward of the outer seal ring and a first plug 60 that extends downwardly from the outer top wall 46 into the chamber 58 as shown in FIGS. 5A and 5B. Both the outer seal ring 56 and the first plug 60 are arranged entirely below the outer top wall 46. The first plug 60 has a syringe-receiving portion 62 that provides the dispenser aperture 18 and is sized to receive the syringe 20 and a flow-stopping portion 63 arranged axially below the syringe-receiving portion 62. The flow-stopping portion 63 has a flow-path diameter that is less than the dispensing aperture 18.

The inner plug unit 42 includes an inner seal ring 64 and a second plug 66 as shown in FIGS. 5A and 5B. The inner seal ring 64 is arranged to extend upwardly from the inner top wall 38 into the chamber 58. The inner seal ring 64 has a diameter that is less than a diameter of the outer seal ring 56 such that an outer surface of the inner seal ring 64 engages an inner surface of the outer seal ring 56 to block fluid from passing therebetween. The second plug 66 extends upwardly away from the inner top wall 38 and engages the first plug 60 when the outer cap 30 is in the closed position to block flow through the fluid passageway. The second plug 66 includes a cap 68 and a plurality of spacer ribs 70 that position the cap 68 above the inner top wall 38 and define a plurality of flow path slots 72 circumferentially between one another. In the opened position, the flow-stopping portion 63 of the first plug 60 is spaced apart from the cap 68 of the second plug to allow flow through the plurality of flow path slots 72 and then through the dispense aperture 18. Each spacer rib 70 may be reinforced with a buttress 73.

The anti-suction feature 24 is configured to block a child from removing fluid through the dispense aperture 18. The anti-suction feature 24 includes an anti-suction ring 74 coupled to an upper surface of outer top wall 46 and a plurality of anti-suction ribs 76 arranged to extend outwardly away from the anti-suction ring 74 toward an outer perimeter of the outer top wall 46 as shown in FIGS. 2-5A. The anti-suction ring 74 is arranged to surround a perimeter edge of the dispense aperture 18. The anti-suction ring 74 is castellated such that it is formed to include a plurality of slots 78 spaced circumferentially apart from one another around the dispense aperture 18. The plurality of anti-suction ribs 76 are spaced apart from one another to provide a plurality of airflow recesses 80 therebetween and at least one slot of the plurality of slots formed in the anti-suction ring is aligned with each airflow recess 80 provided by the plurality of anti-suction ribs 76.

When a user, such as a child, presses his/her lips over the dispense aperture 18, the user's lips engage at least one of the anti-suction ring 74 and the plurality of anti-suction ribs 76. The location of the slots 78 in the anti-suction ring 74 relative to the plurality of anti-suction ribs 76 blocks the user's lips from forming a complete seal on the outer cap 30 over the dispense aperture 18. If the user applies a suction force on the outer cap 30, the anti-suction feature 24 allows for air to flow between the ribs 76 and through the slots 78 and into the user's mouth thereby blocking the user from forming a sufficient suction force that would remove the fluid from the container 12.

The outer cap 30 is formed to include a plurality of bypass apertures 82 as shown in FIGS. 3-5B. The bypass apertures 82 extend through the cap 18 and are located directly adjacent to the anti-suction feature 24. In the illustrative embodiment, each bypass aperture 82 is located circumferentially between two neighboring anti-suction ribs 76. In some embodiment, a bypass aperture 82 is located circumferentially between each rib 76. The inner side wall 40 of the inner cap 28 is formed to includes a plurality of axially-extending slots 84 as shown in FIG. 5A. Air can flow between the outer side wall 48 and the inner side wall 40 through the axially-extending slots 84 to the bypass apertures 82. Each bypass aperture is offset from the chamber 58 such that the dispense aperture 18 and the bypass apertures 82 are each a part of a fluid separate circuit formed by the closure 14. If the user attempts to provide a sufficient suction force on the outer cap 30 and the anti-suction feature 24, the bypass apertures 82 allow air to flow therethrough and into the users mouth thereby blocking the user from forming a sufficient suction force over the dispense aperture 18 that would remove fluid from the container 12.

The closure-release mechanism 26 cooperates with the anti-suction feature 24 to provide a child-resistant closure 14 by both blocking the closure 14 from changing from the closed arrangement to the opened arrangement and, if successful in reaching the opened arrangement, controlling removal of fluid from through the dispense aperture 18. In use, a user activates the closure-release mechanism 26 to allow the outer cap 30 to rotate in a counter-clockwise direction relative to the inner cap 28. During rotation of the outer cap 30 in the counter-clockwise direction, the outer cap 30 also translates along a vertical axis 25 relative to the container 12 and the inner cap 28 to establish the opened arrangement of the closure 14 as shown in FIG. 5B.

The closure-release mechanism 26 includes two pads 86, 87, two tabs 88, 89, and two tab blockers 90, 91 as suggested in FIG. 6. The two pads 86, 87 are coupled to the outer cap 30 in a fixed position relative to the outer cap 30 opposite one another. The tabs 88, 89 are coupled an inner surface of the outer cap 30 opposite one another. The tabs 88, 89 are offset 90 degrees from the pads 86, 87. The two outwardly extending tab blockers 90, 91 are coupled to the container 12 in a fixed position on the container 12 and are configured to block rotation of the outer cap 30 and tabs 88, 89 until the pads 86, 87 are pressed inwardly causing the tabs 88, 89 to move radially outward past the tab blockers 90, 91 to allow the user to rotate the outer cap 30 in the counter-clockwise direction past the tab blockers 90, 91 to establish the opened arrangement of the closure 14. As a result, the closure-release mechanism 26 provides a child-resistant package 10.

The inner cap 28 includes three closure-release guides 92, 93, 94 mounted on inner side wall 40 as suggested in FIG. 6. The carrier body 36 is coupled to the container 12 in a fixed position relative to the container 12. The rotation guides 92, 93, 94 are coupled to an outer surface of the inner side wall 40. The outer side wall 48 is formed to include three closure-release guide slots 95, 96, 97 as suggested in FIG. 6. Each rotation guide 92, 93, 94 is configured to extend into and mate with an associated guide slot 95, 96, 97 formed in the outer cap 30. The guide slots 95, 96, 97 and rotation guides 92, 93, 94 cooperate to guide movement of the outer cap 18 relative to the inner cap 28 during rotation in the counter-clockwise direction to cause the outer cap 30 to move axially away from the inner cap 28 to establish the opened arrangement of the closure 14.

Each of the closure-release guide slots 95, 96, 97 has an axially-extending portion 98 and a circumferentially-extending portion 99 as shown in FIG. 6. Each axially-extending portion 98 is configured to provide a snap-fit retention feature for a corresponding one of the plurality of closure-release guides 92, 93, 94 when the outer cap is moved axially relative to the inner cap 28 during installation until each corresponding one of the plurality of closure-release guides 92, 93, 94 reaches the circumferentially-extending portion 99 of the closure-release guide slots 95, 96, 97 to retain each of the closure-release guides 92, 93, 94 within the circumferentially-extending portions 99. Each of the closure-release guide slots 95, 96, 97 is defined by a ledge 100 that separates the axially-extending portions 98 from the circumferentially-extending portions 99.

The closure of the present disclosure is squeezed out of round to release the outer closure to raise up, and in a quarter turn, to allow access to product by establishing the opened arrangement. The closure of the present disclosure may include a lengthened spout with an orifice reduction diameter that is the similar inner diameter (ID) to a dosing syringe. This spout may restrict or eliminate flow when the dosing syringe is not engaging the closure. Designs with larger through holes may allow the dosing syringe to protrude into the bottle.

The following numbered clauses include embodiments that are contemplated and non-limiting:

Clause 1. A closure comprises an inner cap and an outer cap.

Clause 2. The closure of clause 1, any other clause, or combination of clauses, wherein the inner cap includes an inner top wall formed to include a first opening, an inner side wall arranged to extend downwardly from the inner top wall and circumferentially around a central axis, and an inner plug unit coupled to an outer surface of the inner top wall and arranged to extend upwardly away from the inner top wall.

Clause 3. The closure of clause 2, any other clause, or combination of clauses, wherein the outer cap includes an outer top wall formed to include a second opening, an outer side wall arranged to extend downwardly from the outer top wall and that extends circumferentially about the central axis, and an outer plug unit coupled to a bottom surface of the outer top wall and arranged to extend downwardly away from the top wall.

Clause 4. The closure of clause 3, any other clause, or combination of clauses, wherein the outer cap being mounted to the inner cap for rotation relative to the inner cap about the central axis from a closed position in which the outer top wall and the inner top wall are spaced apart from one another by a first distance and the inner plug unit and the outer plug unit cooperate to block fluid flow through the first and second openings, to an opened position, in which the outer top wall is spaced apart from the inner top wall by a second distance greater than the first distance and first and second openings are opened to allow fluid to flow therethrough.

Clause 5. The closure of clause 4, any other clause, or combination of clauses, wherein the outer cap being adapted to receive a syringe to remove a fluid from the chamber when the outer cap is in the opened position.

Clause 6. The closure of clause 5, any other clause, or combination of clauses, further comprising anti-suction means for blocking formation of a seal between a child's mouth and an upper surface of the outer top wall so that, if the child attempts to apply a suction force on the outer top wall over the second opening, air is drawn into the child's mouth without any fluid being removed through the second opening.

Clause 7. The closure of clause 6, any other clause, or combination of clauses, wherein the anti-suction means includes an anti-suction ring coupled to the upper surface of outer top wall and arranged to surround a perimeter edge of the first opening and a plurality of anti-suction ribs arranged to extend outwardly away from the anti-suction ring toward an outer perimeter of the outer top wall.

Clause 8. The closure of clause 7, any other clause, or combination of clauses, wherein the anti-suction ring is formed to include a plurality of slots spaced circumferentially apart from one another around the first opening.

Clause 9. The closure of clause 8, any other clause, or combination of clauses, wherein the plurality of anti-suction ribs are spaced apart from one another to provide a plurality of airflow recesses therebetween and at least one slot of the plurality of slots formed in the anti-suction ring is aligned with each space provided by the plurality of anti-suction ribs.

Clause 10. The closure of clause 9, any other clause, or combination of clauses, wherein the outer top wall is formed to include a plurality of bypass apertures arranged to extend through the outer top wall and that are located circumferentially between neighboring ribs of the plurality of ribs.

Clause 11. The closure of clause 10, any other clause, or combination of clauses, wherein the outer side wall is formed to include a plurality of axially-extending slots formed on an inner surface of the outer side wall to allow air to flow between the outer side wall and the inner side wall and through the bypass apertures formed in the outer top wall.

Clause 12. The closure of clause 9, any other clause, or combination of clauses, wherein each of the ribs included in the plurality of ribs has a rib height and each of the slots included in the plurality of slots formed in the anti-suction ring has a slot depth that is less than or equal to the rib height.

Clause 13. The closure of clause 12, any other clause, or combination of clauses, wherein the anti-suction ring has a ring height that is greater than the rib height.

Clause 14. The closure of clause 13, any other clause, or combination of clauses, wherein the rib height is about half of the ring height.

Clause 15. The closure of clause 7, any other clause, or combination of clauses, wherein the outer top wall includes an outer perimeter coupled the outer side wall and a concave bowl arranged to slope downwardly toward the inner top wall as the concave bowl extends inward from the outer perimeter toward the central axis.

Clause 16. The closure of clause 6, any other clause, or combination of clauses, wherein the outer plug unit includes an outer seal ring that extends circumferentially around the central axis to define a chamber radially inward of the outer seal ring and a first plug that extends downwardly from the outer top wall into the chamber.

Clause 17. The closure of clause 16, any other clause, or combination of clauses, wherein the outer plug unit is entirely below the outer top wall and the outer top wall includes an outer perimeter coupled the outer side wall and a concave bowl arranged to slope downwardly toward the inner top wall as the concave bowl extends inward from the outer perimeter toward the central axis.

Clause 18. The closure of clause 17, any other clause, or combination of clauses, wherein the inner plug unit includes an inner seal ring and a second plug, the inner seal arranged to extend upwardly from the inner top wall into the chamber and has a diameter that is less than a diameter of the outer seal ring such that an outer surface of the anti-suction ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber.

Clause 19. The closure of clause 18, any other clause, or combination of clauses, wherein the second plug includes an upper cap spaced apart from the inner top wall and a plurality of spacer ribs that interconnect the inner top wall and the upper cap and define a plurality of slots between one another, and the upper cap extends into the first plug when the outer cap is in the closed position to block fluid flow through the chamber.

Clause 20. The closure of claim 12, wherein the first plug and the second plug are spaced apart from one another when the outer cap is in the opened position to allow fluid flow through the plurality of slots and the chamber and out of the second opening in the outer top wall.

Clause 21. The closure of clause 6, any other clause, or combination of clauses, further comprising a closure-release mechanism includes first and second lock tabs coupled to an inner surface of the side wall of the outer cap and arranged to extend inwardly toward the central axis, first and second tab blockers fixed in position relative to the outer cap and that engage the first and second lock tabs in the closed position to block rotation of the outer cap relative to the inner cap from the closed position to the opened position until an inward force is applied on the outer side wall of the outer cap sufficient to deform the outer cap and move the first and second lock tabs outwardly away from the first and second tab blockers.

Clause 22. A closure comprises, an inner cap, an outer cap, and a child-resistant closure release mechanism.

Clause 23. The closure of clause 22, any other clause, or combination of clauses, wherein the inner cap includes an inner top wall formed to include a first opening, an inner side wall arranged to extend downwardly from the inner top wall and circumferentially around a central axis, and an inner plug unit coupled to an outer surface of the inner top wall and arranged to extend upwardly away from the inner top wall.

Clause 24. The closure of clause 23, any other clause, or combination of clauses, wherein the outer cap includes an outer top wall formed to include a second opening, an outer side wall arranged to extend downwardly from the outer top wall and that extends circumferentially about the central axis, and an outer plug unit coupled to a bottom surface of the outer top wall and arranged to extend downwardly away from the top wall, the outer cap being mounted to the inner cap for rotation relative to the inner cap about the central axis from a closed position in which the outer top wall and the inner top wall are spaced apart from one another by a first distance and the inner plug unit and the outer plug unit cooperate to block fluid flow through the first and second openings, to an opened position, in which the outer top wall is spaced apart from the inner top wall by a second distance greater than the first distance and first and second openings are opened to allow fluid to flow therethrough, the outer cap being adapted to receive a syringe to remove a fluid from the chamber when the outer cap is in the opened position.

Clause 25. The closure of clause 24, any other clause, or combination of clauses, wherein the child-resistant closure-release mechanism is configured to block rotation of the outer cap relative to the inner cap from the closed position to the opened position.

Clause 26. The closure of clause 25, any other clause, or combination of clauses, wherein the outer plug unit is arranged entirely below the outer top wall and the outer top wall includes an outer perimeter coupled the outer side wall and a concave bowl arranged to slope downwardly toward the inner top wall as the concave bowl extends inward from the outer perimeter toward the central axis, and wherein the outer plug unit includes an outer seal ring that extends circumferentially around the central axis to define a chamber radially inward of the outer seal ring and a first plug that extends downwardly from the outer top wall into the chamber.

Clause 27. The closure of clause 26, any other clause, or combination of clauses, wherein the inner plug unit includes an inner seal ring and a second plug, the inner seal arranged to extend upwardly from the inner top wall into the chamber and has a diameter that is less than a diameter of the outer seal ring such that an outer surface of the inner seal ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber.

Clause 28. The closure of clause 27, any other clause, or combination of clauses, wherein the second plug includes an upper cap spaced apart from the inner top wall and a plurality of spacer ribs that interconnect the inner top wall and the upper cap and define a plurality of slots between one another, and the upper cap extends into the first plug when the outer cap is in the closed position to block fluid flow through the chamber.

Clause 29. The closure of clause 28, any other clause, or combination of clauses, wherein the first plug and the second plug are spaced apart from one another when the outer cap is in the opened position to allow fluid flow through the plurality of slots and the chamber and out of the second opening in the outer top wall.

Clause 30. The closure of clause 25, any other clause, or combination of clauses, wherein the closure-release mechanism includes first and second lock tabs coupled to an inner surface of the side wall of the outer cap and arranged to extend inwardly toward the central axis, first and second tab blockers fixed in position relative to the outer cap and that engage the first and second lock tabs in the closed position to block rotation of the outer cap relative to the inner cap from the closed position to the opened position until an inward force is applied on the outer side wall of the outer cap sufficient to deform the outer cap and move the first and second lock tabs outwardly away from the first and second tab blockers.

Clause 31. The closure of clause 25, any other clause, or combination of clauses, further comprising a plurality of closure-release guides coupled to the inner side wall and configured to control movement of the outer cap relative to the inner cap and to retain the outer cap to the inner cap, each closure release guide of the plurality of closure release guides being arranged in a separate closure-release guide slot formed in the outer side wall.

Clause 32. The closure of clause 31, any other clause, or combination of clauses, wherein each of the closure-release guide slots has an axially-extending portion and a circumferentially-extending portion.

Clause 33. The closure of clause 32, any other clause, or combination of clauses, wherein each axially-extending portion is configured to provide a snap-fit retention feature for a corresponding one of the plurality of closure-release guides when the outer cap is moved axially relative to the inner cap during installation until each corresponding one of the plurality of closure-release guides reaches the circumferentially-extending portion of the closure-release guide slots to retain each of the closure-release guides within the circumferentially-extending portions.

Clause 34. The closure of clause 33, any other clause, or combination of clauses, wherein each of the closure-release guide slots is defined by a ledge that separates the axially-extending portions from the circumferentially-extending portions, and the outer side wall has a first diameter at the circumferentially-extending portions and a second diameter less than the first diameter at the ledge.

Clause 35. The closure of clause 25, any other clause, or combination of clauses, further comprising anti-suction means includes an anti-suction ring coupled to the upper surface of outer top wall and arranged to surround a perimeter edge of the first opening and a plurality of anti-suction ribs arranged to extend outwardly away from the anti-suction ring toward an outer perimeter of the outer top wall.

Clause 36. The closure of clause 35, any other clause, or combination of clauses, wherein the anti-suction ring is formed to include a plurality of slots spaced circumferentially apart from one another around the first opening.

Clause 37. The closure of clause 36, any other clause, or combination of clauses, wherein the plurality of anti-suction ribs are spaced apart from one another to provide a plurality of airflow recesses therebetween and at least one slot of the plurality of slots formed in the anti-suction ring is aligned with each space provided by the plurality of anti-suction ribs.

Clause 38. The closure of clause 37, any other clause, or combination of clauses, wherein the outer top wall is formed to include a plurality of bypass apertures arranged to extend through the outer top wall and that are located circumferentially between neighboring ribs of the plurality of ribs.

Clause 39. The closure of clause 38, any other clause, or combination of clauses, wherein the outer side wall is formed to include a plurality of axially-extending slots formed on an inner surface of the outer side wall to allow air to flow between the outer side wall and the inner side wall and through the bypass apertures formed in the outer top wall.

Clause 40. The closure of clause 35, any other clause, or combination of clauses, wherein each of the ribs included in the plurality of ribs has a rib height and each of the slots included in the plurality of slots formed in the anti-suction ring has a slot depth that is less than or equal to the rib height.

Clause 41. The closure of clause 40, any other clause, or combination of clauses, wherein the anti-suction ring has a ring height that is greater than the rib height.

Clause 42. The closure of clause 41, any other clause, or combination of clauses, wherein the rib height is about half of the ring height.

Clause 43. The closure of clause 25, any other clause, or combination of clauses, wherein the outer top wall includes an outer perimeter coupled the outer side wall and a concave bowl arranged to slope downwardly toward the inner top wall as the concave bowl extends inward from the outer perimeter toward the central axis.

Clause 44. A closure comprises an inner cap, an outer cap, and an anti-suction feature.

Clause 45. The closure of clause 44, any other clause, or combination of clauses, wherein the inner cap includes an inner top wall formed to include a first opening and an inner side wall arranged to extend downwardly from the inner top wall and circumferentially around a central axis.

Clause 46. The closure of clause N, any other clause, or combination of clauses, wherein the outer cap includes an outer top wall formed to include a second opening, an outer side wall arranged to extend downwardly from the outer top wall and that extends circumferentially about the central axis, the outer cap being mounted to the inner cap for rotation relative to the inner cap about the central axis from a closed position to an opened position.

Clause 47. The closure of clause 46, any other clause, or combination of clauses, wherein the anti-suction feature is coupled to an upper surface of the outer top wall and arranged circumferentially around the second opening and configured to block formation of a seal between a child's mouth and an upper surface of the outer top wall so that, if the child attempts to apply a suction force on the outer top wall over the second opening, air is drawn into the child's mouth without any fluid being removed through the second opening.

Clause 48. The closure of clause 47, any other clause, or combination of clauses, wherein the anti-suction means includes an anti-suction ring coupled to the upper surface of outer top wall and arranged to surround a perimeter edge of the first opening and a plurality of anti-suction ribs arranged to extend outwardly away from the anti-suction ring toward an outer perimeter of the outer top wall.

Clause 49. The closure of clause 48, any other clause, or combination of clauses, wherein the anti-suction ring is formed to include a plurality of slots spaced circumferentially apart from one another around the first opening.

Clause 50. The closure of clause 49, any other clause, or combination of clauses, wherein the plurality of anti-suction ribs are spaced apart from one another to provide a plurality of airflow recesses therebetween and at least one slot of the plurality of slots formed in the anti-suction ring is aligned with each space provided by the plurality of anti-suction ribs.

Clause 51. The closure of clause 50, any other clause, or combination of clauses, wherein the outer top wall is formed to include a plurality of bypass apertures arranged to extend through the outer top wall and that are located circumferentially between neighboring ribs of the plurality of ribs.

Clause 52. The closure of clause 51, any other clause, or combination of clauses, wherein the outer side wall is formed to include a plurality of axially-extending slots formed on an inner surface of the outer side wall to allow air to flow between the outer side wall and the inner side wall and through the bypass apertures formed in the outer top wall.

Clause 53. The closure of clause 52, any other clause, or combination of clauses, wherein each of the ribs included in the plurality of ribs has a rib height and each of the slots included in the plurality of slots formed in the anti-suction ring has a slot depth that is less than or equal to the rib height.

Clause 54. The closure of clause 53, any other clause, or combination of clauses, wherein the anti-suction ring has a ring height that is greater than the rib height.

Clause 55. The closure of clause 54, any other clause, or combination of clauses, wherein the rib height is about half of the ring height.

Clause 56. The closure of clause 47, any other clause, or combination of clauses, wherein the outer top wall includes an outer perimeter coupled the outer side wall and a concave bowl arranged to slope downwardly toward the inner top wall as the concave bowl extends inward from the outer perimeter toward the central axis.

Clause 57. The closure of clause 56, any other clause, or combination of clauses, further comprising an outer plug unit that includes an outer seal ring that extends circumferentially around the central axis to define a chamber radially inward of the outer seal ring and a first plug that extends downwardly from the outer top wall into the chamber.

Clause 58. The closure of clause 57, any other clause, or combination of clauses, wherein the outer plug unit is entirely below the outer top wall and the outer top wall includes an outer perimeter coupled the outer side wall and a concave bowl arranged to slope downwardly toward the inner top wall as the concave bowl extends inward from the outer perimeter toward the central axis.

Clause 59. The closure of clause 58, any other clause, or combination of clauses, further comprising an inner plug unit that includes an inner seal ring and a second plug, the inner seal arranged to extend upwardly from the inner top wall into the chamber and has a diameter that is less than a diameter of the outer seal ring such that an outer surface of the anti-suction ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber.

Clause 60. The closure of clause 59, any other clause, or combination of clauses, wherein the second plug includes an upper cap spaced apart from the inner top wall and a plurality of spacer ribs that interconnect the inner top wall and the upper cap and define a plurality of slots between one another, and the upper cap extends into the first plug when the outer cap is in the closed position to block fluid flow through the chamber.

Clause 61. The closure of clause 60, any other clause, or combination of clauses, wherein the first plug and the second plug are spaced apart from one another when the outer cap is in the opened position to allow fluid flow through the plurality of slots and the chamber and out of the second opening in the outer top wall.

Clause 62. The closure of clause 47, any other clause, or combination of clauses, further comprising a closure-release mechanism that includes first and second lock tabs coupled to an inner surface of the side wall of the outer cap and arranged to extend inwardly toward the central axis, first and second tab blockers fixed in position relative to the outer cap and that engage the first and second lock tabs in the closed position to block rotation of the outer cap relative to the inner cap from the closed position to the opened position until an inward force is applied on the outer side wall of the outer cap sufficient to deform the outer cap and move the first and second lock tabs outwardly away from the first and second tab blockers.

Clause 63. The closure of clause 47, any other clause, or combination of clauses, wherein further comprising a plurality of closure-release guides coupled to the inner side wall and configured to control movement of the outer cap relative to the inner cap and to retain the outer cap to the inner cap, each closure release guide of the plurality of closure release guides being arranged in a separate closure-release guide slot formed in the outer side wall.

Clause 64. The closure of clause 63, any other clause, or combination of clauses, wherein each of the closure-release guide slots has an axially-extending portion and a circumferentially-extending portion.

Clause 65. The closure of clause 64, any other clause, or combination of clauses, wherein each axially-extending portion is configured to provide a snap-fit retention feature for a corresponding one of the plurality of closure-release guides when the outer cap is moved axially relative to the inner cap during installation until each corresponding one of the plurality of closure-release guides reaches the circumferentially-extending portion of the closure-release guide slots to retain each of the closure-release guides within the circumferentially-extending portions.

Clause 66. The closure of clause 66, any other clause, or combination of clauses, wherein each of the closure-release guide slots is defined by a ledge that separates the axially-extending portions from the circumferentially-extending portions, and the outer side wall has a first diameter at the circumferentially-extending portions and a second diameter less than the first diameter at the ledge.

The invention claimed is:

1. A closure comprising an inner cap including an inner top wall formed to include a first opening, an inner side wall arranged to extend downwardly from the inner top wall and circumferentially around a central axis, and an inner plug unit coupled to an outer surface of the inner top wall and arranged to extend upwardly away from the inner top wall, an outer cap including an outer top wall formed to include a second opening, an outer side wall arranged to extend downwardly from the outer top wall and that extends circumferentially about the central axis, and an outer plug unit coupled to a bottom surface of the outer top wall and arranged to extend downwardly away from the top wall, the outer cap being mounted to the inner cap for rotation relative to the inner cap about the central axis from a closed position in which the outer top wall and the inner top wall are spaced apart from one another by a first distance and the inner plug unit and the outer plug unit cooperate to block fluid flow through the first and second openings, to an opened position, in which the outer top wall is spaced apart from the inner top wall by a second distance greater than the first distance and first and second openings are opened to allow fluid to flow therethrough, the outer cap being adapted to receive a syringe to remove a fluid from the chamber when the outer cap is in the opened position, and an anti-suction feature configured to block formation of a seal between a child's mouth and an upper surface of the outer top wall so that, if the child attempts to apply a suction force on the outer top wall over the second opening, air is drawn into the child's mouth without any fluid being removed through the second opening, wherein the anti-suction feature includes an anti-suction ring coupled to the upper surface of outer top wall and arranged to surround a perimeter edge of the first opening and the anti-suction ring is formed to include a plurality of slots spaced circumferentially apart from one another around the first opening.

2. The closure of claim 1, wherein the anti-suction feature further includes a plurality of anti-suction ribs arranged to extend outwardly away from the anti-suction ring toward an outer perimeter of the outer top wall.

3. The closure of claim 2, wherein the plurality of anti-suction ribs are spaced apart from one another to provide a plurality of airflow recesses therebetween and at least one slot of the plurality of slots formed in the anti-suction ring is aligned with each space provided by the plurality of anti-suction ribs.

4. The closure of claim 3, wherein the outer top wall is formed to include a plurality of bypass apertures arranged to extend through the outer top wall and that are located circumferentially between neighboring ribs of the plurality of ribs.

5. The closure of claim 4, wherein the outer side wall is formed to include a plurality of axially-extending slots formed on an inner surface of the outer side wall to allow air to flow between the outer side wall and the inner side wall and through the bypass apertures formed in the outer top wall.

6. The closure of claim 2, wherein each of the ribs included in the plurality of ribs has a rib height and each of the slots included in the plurality of slots formed in the anti-suction ring has a slot depth that is less than or equal to the rib height.

7. The closure of claim 6, wherein the anti-suction ring has a ring height that is greater than the rib height.

8. The closure of claim 7, wherein the rib height is about half of the ring height.

9. The closure of claim 2, wherein the outer top wall includes an outer perimeter coupled the outer side wall and a concave bowl arranged to slope downwardly toward the inner top wall as the concave bowl extends inward from the outer perimeter toward the central axis.

10. The closure of claim 1, wherein the outer plug unit includes an outer seal ring that extends circumferentially around the central axis to define a chamber radially inward of the outer seal ring and a first plug that extends downwardly from the outer top wall into the chamber, and wherein the outer plug unit is entirely below the outer top wall and the outer top wall includes an outer perimeter coupled the outer side wall and a concave bowl arranged to slope downwardly toward the inner top wall as the concave bowl extends inward from the outer perimeter toward the central axis.

11. The closure of claim 10, wherein the inner plug unit includes an inner seal ring and a second plug, the inner seal arranged to extend upwardly from the inner top wall into the chamber and has a diameter that is less than a diameter of the outer seal ring such that an outer surface of the inner seal ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber, and wherein the second plug includes an upper cap spaced apart from the inner top wall and a plurality of spacer ribs that interconnect the inner top wall and the upper cap and define a plurality of slots between one another, and the upper cap extends into the first plug when the outer cap is in the closed position to block fluid flow through the chamber.

12. The closure of claim 11, wherein the first plug and the second plug are spaced apart from one another when the outer cap is in the opened position to allow fluid flow through the plurality of slots and the chamber and out of the second opening in the outer top wall.

13. The closure of claim 1, further comprising a closure-release mechanism includes first and second lock tabs coupled to an inner surface of the side wall of the outer cap and arranged to extend inwardly toward the central axis, first and second tab blockers fixed in position relative to the outer cap and that engage the first and second lock tabs in the closed position to block rotation of the outer cap relative to the inner cap from the closed position to the opened position until an inward force is applied on the outer side wall of the outer cap sufficient to deform the outer cap and move the first and second lock tabs outwardly away from the first and second tab blockers.

14. A closure comprising an inner cap including an inner top wall formed to include a first opening, an inner side wall arranged to extend downwardly from the inner top wall and circumferentially around a central axis, and an inner plug unit coupled to an outer surface of the inner top wall and arranged to extend upwardly away from the inner top wall, an outer cap including an outer top wall formed to include a second opening, an outer side wall arranged to extend downwardly from the outer top wall and that extends circumferentially about the central axis, and an outer plug unit coupled to a bottom surface of the outer top wall and arranged to extend downwardly away from the top wall, the outer cap being mounted to the inner cap for rotation relative to the inner cap about the central axis from a closed position in which the outer top wall and the inner top wall are spaced apart from one another by a first distance and the inner plug unit and the outer plug unit cooperate to block fluid flow through the first and second openings, to an opened position, in which the outer top wall is spaced apart from the inner top wall by a second distance greater than the first distance and first and second openings are opened to allow fluid to flow therethrough, the outer cap being adapted to receive a syringe to remove a fluid from the chamber when the outer cap is in the opened position, and a child-resistant closure-release mechanism configured to block rotation of the outer cap relative to the inner cap from the closed position to the opened position, wherein the outer plug unit includes an outer seal ring that extends circumferentially around the central axis to define a chamber radially inward of the outer seal ring and a first plug that extends downwardly from the outer top wall into the chamber.

15. The closure of claim 14, further comprising an anti-suction feature including an anti-suction ring coupled to the upper surface of outer top wall and arranged to surround a perimeter edge of the first opening and a plurality of anti-suction ribs arranged to extend outwardly away from the anti-suction ring toward an outer perimeter of the outer top wall, wherein the anti-suction ring is formed to include a plurality of slots spaced circumferentially apart from one another around the first opening, and wherein the plurality of anti-suction ribs are spaced apart from one another to provide a plurality of airflow recesses therebetween and at least one slot of the plurality of slots formed in the anti-suction ring is aligned with each space provided by the plurality of anti-suction ribs.

16. The closure of claim 14, wherein the outer plug unit is arranged entirely below the outer top wall and the outer top wall includes an outer perimeter coupled the outer side wall and a concave bowl arranged to slope downwardly toward the inner top wall as the concave bowl extends inward from the outer perimeter toward the central axis.

17. The closure of claim 15, wherein the inner plug unit includes an inner seal ring and a second plug, the inner seal arranged to extend upwardly from the inner top wall into the chamber and has a diameter that is less than a diameter of the outer seal ring such that an outer surface of the inner seal ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber.

18. A closure comprising an inner cap including an inner top wall formed to include a first opening and an inner side wall arranged to extend downwardly from the inner top wall and circumferentially around a central axis, an outer cap including an outer top wall formed to include a second opening, an outer side wall arranged to extend downwardly from the outer top wall and that extends circumferentially about the central axis, the outer cap being mounted to the inner cap for rotation relative to the inner cap about the central axis from a closed position to an opened position, and an anti-suction feature coupled to an upper surface of the outer top wall and arranged circumferentially around the second opening and configured to block formation of a seal between a child's mouth and an upper surface of the outer top wall so that, if the child attempts to apply a suction force on the outer top wall over the second opening, air is drawn into the child's mouth without any fluid being removed through the second opening, wherein the anti-suction feature includes an anti-suction ring coupled to the upper surface of outer top wall and arranged to surround a perimeter edge of the first opening and a plurality of anti-suction ribs arranged to extend outwardly away from the anti-suction ring toward an outer perimeter of the outer top wall.

19. The closure of claim 18, wherein the inner cap further includes an inner plug unit and the outer cap further includes an outer plug unit, the outer plug unit is arranged entirely below the outer top wall, wherein the outer plug unit includes an outer seal ring that extends circumferentially around the central axis to define a chamber radially inward of the outer seal ring and a first plug that extends downwardly from the outer top wall into the chamber, and wherein the inner plug unit includes an inner seal ring and a second plug, the inner seal arranged to extend upwardly from the inner top wall into the chamber and has a diameter that is less than a diameter of the outer seal ring such that an outer surface of the inner seal ring engages an inner surface of the outer seal ring to block fluid from passing between the outer seal ring and the inner seal ring, and wherein the second plug extends upwardly away from the inner top wall and engages the first plug when the outer cap is in the closed position to block fluid flow out of the chamber.

* * * * *